US008813704B2

(12) United States Patent
Kim et al.

(10) Patent No.: US 8,813,704 B2
(45) Date of Patent: Aug. 26, 2014

(54) CONTINUOUS VARIABLE VALVE DURATION APPARATUS

(75) Inventors: Back Sik Kim, Osan-si (KR); Sang Hee Lee, Hwaseong-si (KR); Kwangsoon Choi, Ansan-si (KR); Joong Soo Kim, Ansan-si (KR); Dae Sung Kim, Hwaseong-si (KR); Hyuk Im, Suwon-si (KR); Kyoung Pyo Ha, Suwon (KR)

(73) Assignee: Hyundai Motor Company, Seoul (KR)

( * ) Notice: Subject to any disclaimer, the term of this patent is extended or adjusted under 35 U.S.C. 154(b) by 56 days.

(21) Appl. No.: 13/551,208

(22) Filed: Jul. 17, 2012

(65) Prior Publication Data

US 2013/0146006 A1 Jun. 13, 2013

(30) Foreign Application Priority Data

Dec. 7, 2011 (KR) ..... 10-2011-0130396

(51) Int. Cl.
*F01L 1/18* (2006.01)

(52) U.S. Cl.
USPC ..... 123/90.44; 123/90.16; 123/90.39; 123/90.6

(58) Field of Classification Search
CPC ..... F01L 1/0532; F01L 1/267; F01L 1/356
USPC ..... 123/90.16, 90.6, 90.39, 90.44
See application file for complete search history.

(56) References Cited

U.S. PATENT DOCUMENTS 5,365,896 A * 11/1994 Hara et al. ..... 123/90.17

FOREIGN PATENT DOCUMENTS

| | | | |
|---|---|---|---|
| JP | 06-002516 | | 1/1994 |
| JP | 8-232622 | A | 9/1996 |
| JP | 2009-236010 | A | 10/2009 |
| JP | 2010-037996 | A | 2/2010 |
| KR | 10-2009-0114946 | A | 11/2009 |

* cited by examiner

*Primary Examiner* — Ching Chang
(74) *Attorney, Agent, or Firm* — Morgan, Lewis & Bockius LLP

(57) ABSTRACT

A continuous variable valve duration apparatus may vary an opening duration of a valve. The continuous variable valve duration apparatus may include a camshaft in which a camshaft slot is formed, a cam portion of which a cam and a cam slot are formed thereto and of which a rotation center is identical to a rotation center of the camshaft and the cam portion of which a phase angle to the cam shaft is variable, and a duration control portion which varies the phase angle between the camshaft slot and the cam slot.

18 Claims, 9 Drawing Sheets

CONTINUOUS VARIABLE VALVE DURATION APPARATUS

CROSS-REFERENCE TO RELATED APPLICATION

The present application claims priority of Korean Patent Application Number 10-2011-0130396 filed Dec. 7, 2011, the entire contents of which application is incorporated herein for all purposes by this reference.

BACKGROUND OF INVENTION

1. Field of Invention

The present invention relates to a continuous variable valve duration apparatus. More particularly, the present invention relates to a continuous variable valve duration apparatus which may vary opening duration of a valve according to operation conditions of an engine with a simple construction.

2. Description of Related Art

An internal combustion engine generates power by burning fuel in a combustion chamber in an air media drawn into the chamber. Intake valves are operated by a camshaft in order to intake the air, and the air is drawn into the combustion chamber while the intake valves are open. In addition, exhaust valves are operated by the camshaft, and a combustion gas is exhausted from the combustion chamber while the exhaust valves are open.

Optimal operation of the intake valves and the exhaust valves depends on a rotation speed of the engine. That is, an optimal lift or optimal opening/closing timing of the valves depends on the rotation speed of the engine. In order to achieve such optimal valve operation depending on the rotation speed of the engine, various researches, such as designing of a plurality of cams and a continuous variable valve lift (CVVL) that can change valve lift according to engine speed, have been undertaken.

Also, in order to achieve such an optimal valve operation depending on the rotation speed of the engine, research has been undertaken on a continuously variable valve timing (CVVT) apparatus that enables different valve timing operations depending on the engine speed. The general CVVT may change valve timing with a fixed valve opening duration.

However, the general CVVL and CVVT are complicated in construction and are expensive in manufacturing cost.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

Various aspects of the present invention provide for a continuous variable valve duration apparatus which may vary opening duration of a valve according to operation conditions of an engine, with a simple construction.

A continuous variable valve duration apparatus according to various aspects of the present invention may include a camshaft in which a camshaft slot is formed, a cam portion of which a cam and a cam slot are formed thereto and of which a rotation center is identical to a rotation center of the camshaft and the cam portion of which a phase angle to the camshaft is variable, and a duration control portion which varies the phase angle between the camshaft slot and the cam slot.

The duration control portion may include a roller guide portion and a roller ring which is rotatably disposed to the roller guide portion and is connected to the camshaft slot and the cam slot, wherein a rotation center of the roller guide portion may be parallel to the rotation center of the camshaft, and the rotation center of the roller guide portion may be varied.

The duration control portion may include a hinge connected to one side of the roller guide portion, and a roller guide portion control portion selectively rotating the roller guide portion around the hinge.

The roller guide portion control portion may include a control slot formed to the roller guide portion, and a control shaft which is parallel to the camshaft, and of which a control pin is eccentrically formed from a center of the control shaft and is inserted into the control slot.

The roller ring may include two guide rollers slidably disposed within the camshaft slot and the cam slot, respectively, and a plurality of contact rollers contacting the roller guide portion.

The roller ring may include two roller plates and two guide roller axes and a plurality of contact roller axes which are formed between the roller plates and the guide rollers and to which the contact rollers are disposed, respectively.

A circumference formed by the guide roller axis may be smaller than a circumference formed by the contact roller axis.

The roller ring may include an upper roller ring and a lower roller ring, and it may be formed by connecting the upper roller ring and the lower roller ring.

The camshaft slot may be formed toward a radial direction thereof, and the camshaft slot direction is eccentric from the rotation center of the camshaft.

The cam slot may be formed toward a radial direction thereof, and the cam slot direction is eccentric from the rotation center of the camshaft.

A cam cap engage portion may be formed to the cam portion.

A cam portion hole may be formed to the cam portion, and the camshaft may be inserted into the cam portion hole.

A continuous variable valve duration apparatus according to various aspects of the present invention may include a camshaft to which a camshaft slot is formed, a cam portion to which a cam and a cam slot are formed and a rotation center is identical to a rotation center of the camshaft and the cam portion of which a phase angle to the cam shaft is variable, a roller guide portion, a roller ring which is rotatably disposed to the roller guide portion and connected to the camshaft slot and the cam slot, a hinge connected to one side of the roller guide portion, and a roller guide portion control portion selectively rotating the roller guide portion around the hinge, wherein a relative phase angle between the camshaft slot and the cam slot may be changed according to operations of the roller guide portion control portion.

The roller guide portion control portion may include a control slot formed to the roller guide portion, and a control shaft which is parallel to the camshaft, and of which a control pin is eccentrically formed from a center of the control shaft and is inserted into the control slot.

The roller ring may include two guide rollers slidably disposed within the camshaft slot and the cam slot respectively, and a plurality of contact rollers contacting the roller guide portion.

The roller ring may include two roller plates and two guide roller axes, and a plurality of contact roller axes which are formed between the roller plates and the guide rollers, and the contact rollers are disposed thereto, respectively.

A circumference formed by the guide roller axis may be smaller than a circumference formed by the contact roller axis.

The roller ring may include an upper roller ring and a lower roller ring, and it may be formed by connecting the upper roller ring and the lower roller ring.

The camshaft slot may be formed toward a radial direction thereof and the camshaft slot direction is eccentric from the rotation center of the camshaft.

The cam slot may be formed toward a radial direction thereof, and the cam slot direction is eccentric from the rotation center of the camshaft.

As described above, various aspects of the present invention provide for a continuous variable valve duration apparatus that may vary an opening duration of a valve according to operation conditions of an engine, with a simple construction.

The continuous variable valve duration apparatus according to various aspects of the present invention may be reduced in size and thus the entire height of a valve train may be reduced.

The continuous variable valve duration apparatus according to various aspects of the present invention may be applied to an engine without excessive design change, and thus productivity may be enhanced and production cost may be reduced.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 1:
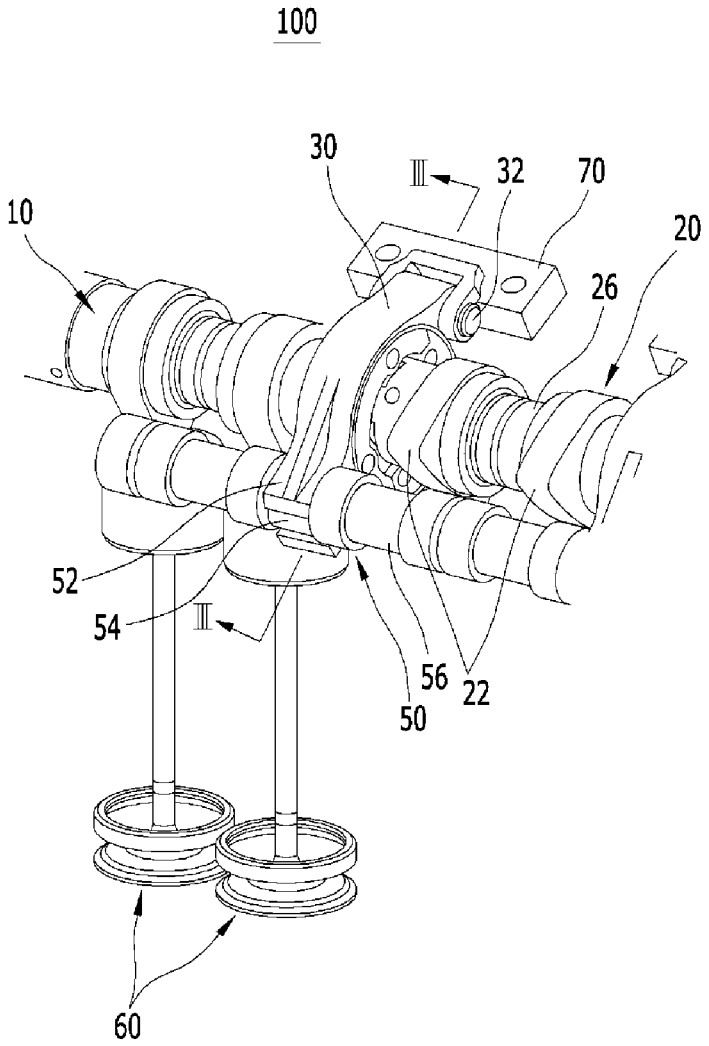
FIG. 1 is a perspective view of an exemplary continuous variable valve duration apparatus according to the present invention.
Figure 2:
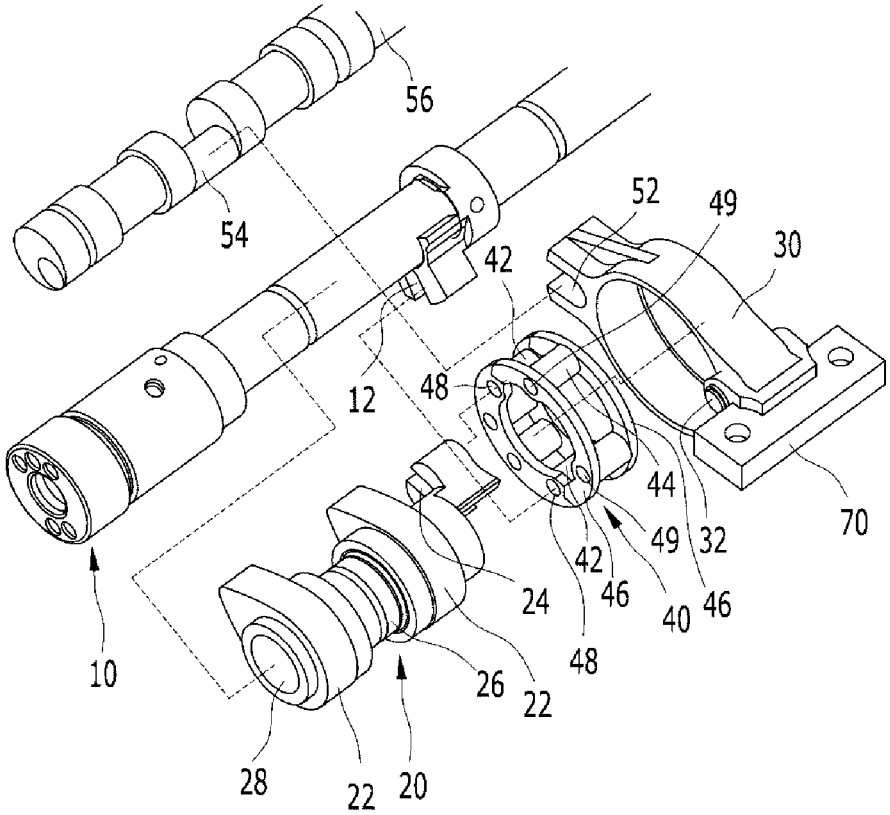
FIG. 2 is an exploded perspective view of an exemplary continuous variable valve duration apparatus according to the present invention.

FIG. 1 is a perspective view of a continuous variable valve duration apparatus according to various embodiments of the present invention, and FIG. 2 is an exploded perspective view of a continuous variable valve duration apparatus according to various embodiments of the present invention.

Figure 3:
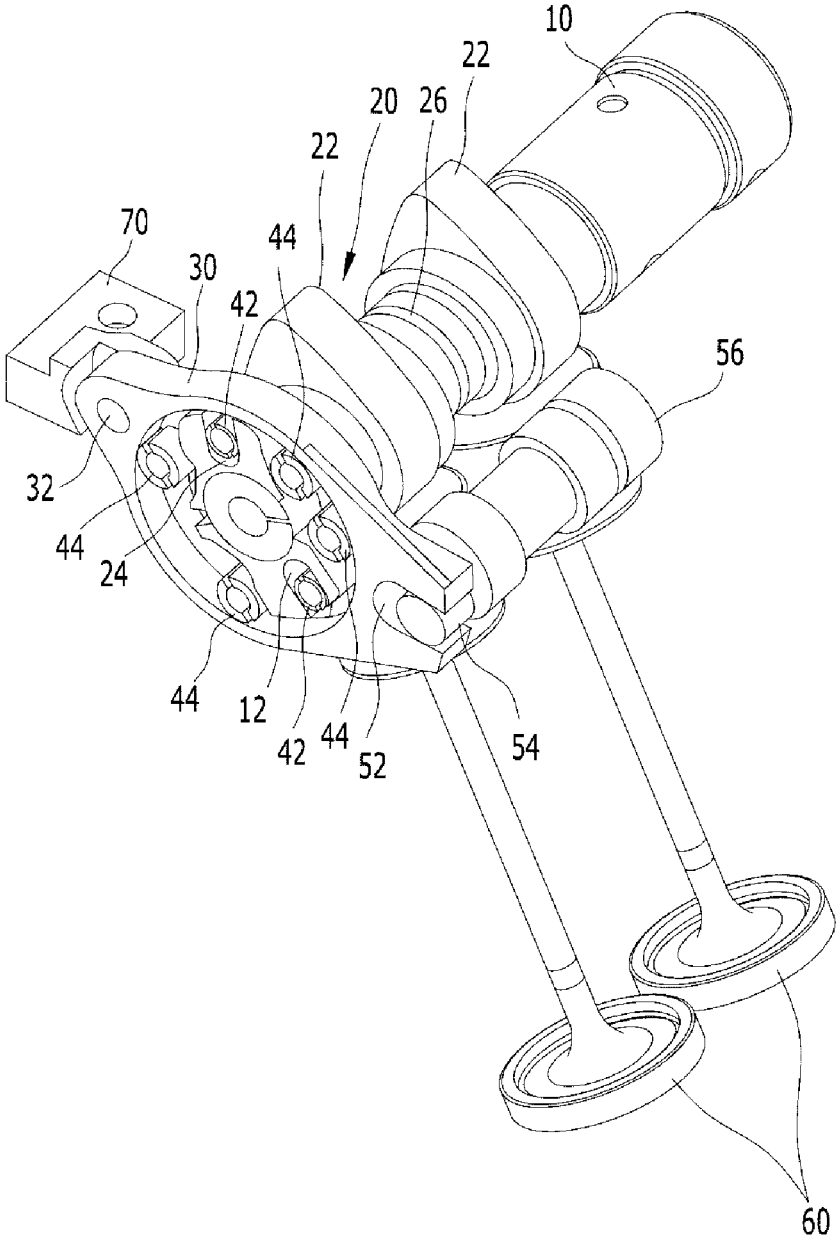
FIG. 3 and FIG. 4 are a cross-sectional perspective view and a cross-sectional view along line III-III of FIG. 1.
Figure 4:
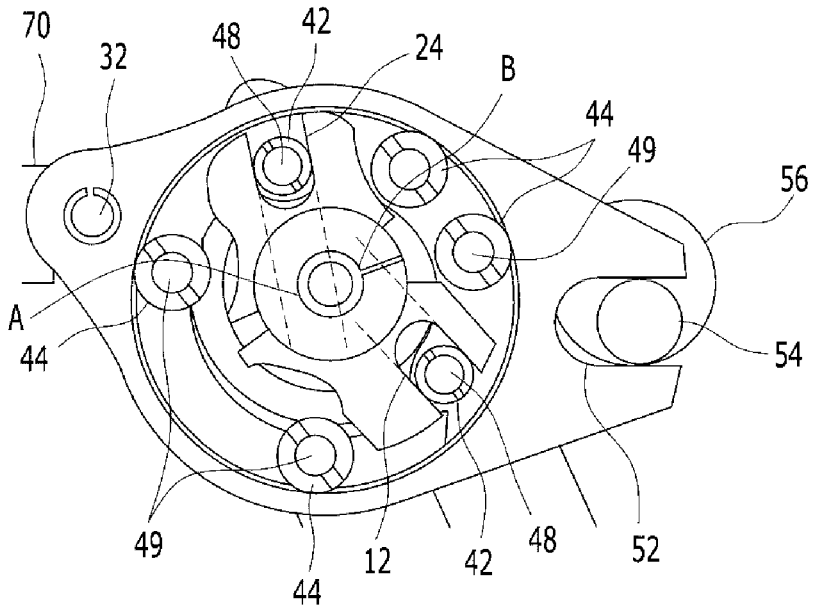

FIG. 3 and FIG. 4 are a cross-sectional perspective view and a cross-sectional view along line III-III of FIG. 1.

A continuous variable valve duration apparatus 100 according to various embodiments of the present invention includes a camshaft 10 in which a camshaft slot 12 is formed, a cam portion 20 of which a cam 22 and a cam slot 24 are formed thereto and of which a rotation center is identical to a rotation center of the camshaft 10 and the cam portion 20 of which a phase angle to the camshaft 10 is variable, and a duration control portion which varies the phase angle between the camshaft slot 12 and the cam slot 24.

The cam portion 20 and the camshaft 10 are inserted into a cam portion hole 28.

The duration control portion includes a roller guide portion 30 and a roller ring 40 which is rotatably disposed to the roller guide portion 30 and connected to the camshaft slot 12 and the cam slot 24, wherein a rotation center of the roller guide portion 30 is parallel to the rotation center of the camshaft 10, and the rotation center of the roller guide portion 30 may vary.

The duration control portion includes a hinge 32 connected to one side of the roller guide portion 30, and a roller guide portion control portion 50 selectively rotating the roller guide portion 30 around the hinge 32.

The hinge 32 is connected to an engine (e.g., cylinder head) through a bracket 70.

The roller guide portion control portion 50 includes a control slot 52 formed to the roller guide portion 30, and a control shaft 56 which is parallel to the camshaft 10 and in which a control pin 54 is eccentrically formed from a center of the control shaft 56 and is inserted into the control slot 52.

However, the scheme of the roller guide portion control portion 50 is not limited thereto, and on the contrary, an actuator or a cylinder may be used for varying the rotation center of the roller guide portion 30.

The camshaft slot 12 may be formed toward a radial direction thereof, and the camshaft slot direction is eccentric from the rotation center of the camshaft 10.

The cam slot 24 may be formed toward a radial direction thereof, and the cam slot direction is eccentric from the rotation center of the camshaft 10.

That is, as shown in FIG. 4, the directions of the cam slot 24 and the camshaft slot 12 may be toward "A" and "B" respectively away from the rotation center of the camshaft 10.

The deviation or offset of each slot 24 and 12 may allow a reduction of size and operation loads of each of the slots 24 and 12 and thus durability of the apparatus may be improved.

Figure 5:
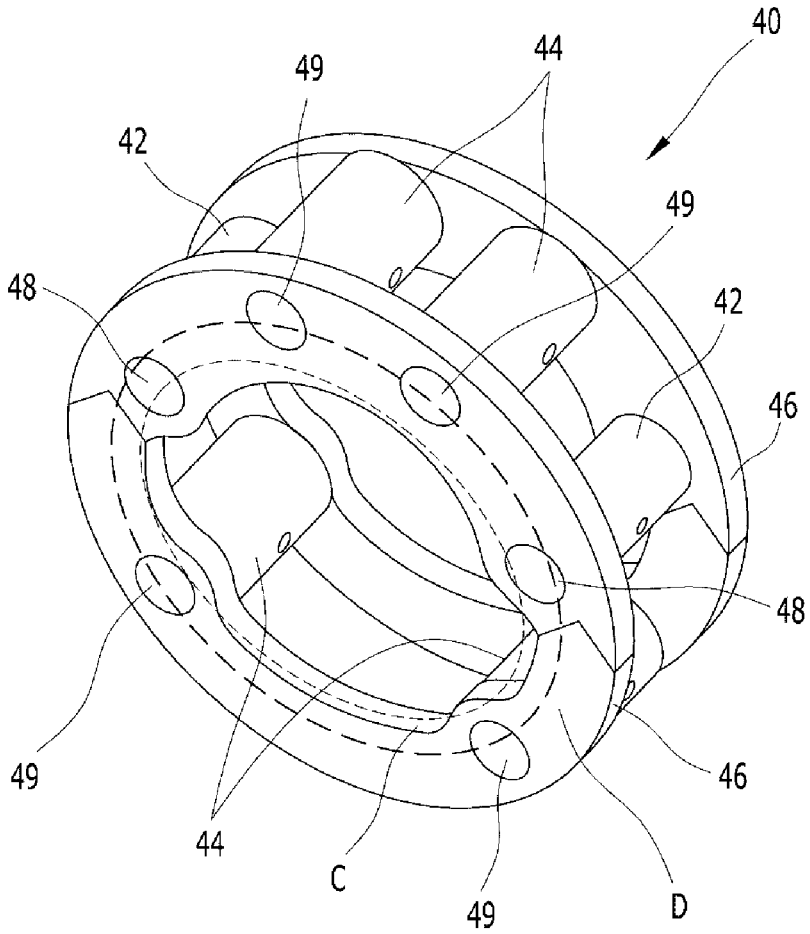
FIG. 5 is a perspective view of a roller ring of an exemplary continuous variable valve duration apparatus according to the present invention.
Figure 6:
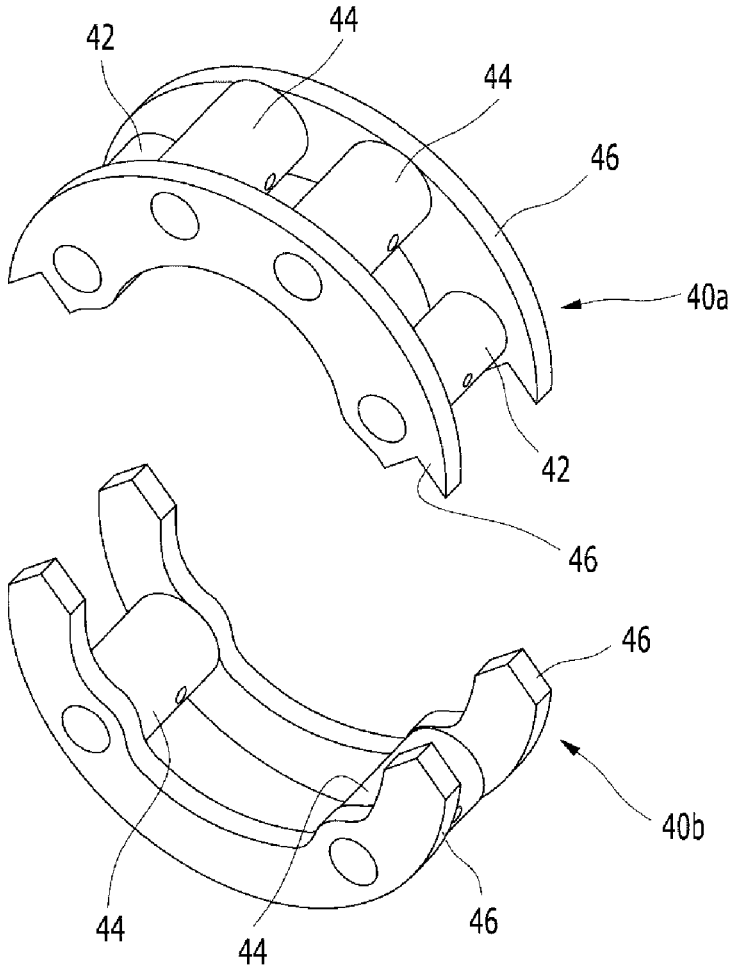
FIG. 6 is an exploded perspective view of a roller ring of an exemplary continuous variable valve duration apparatus according to the present invention.

FIG. 5 is a perspective view of a roller ring of a continuous variable valve duration apparatus according to various embodiments of the present invention, and FIG. 6 is an exploded perspective view of a roller ring of a continuous variable valve duration apparatus according to various embodiments of the present invention.

Referring to FIG. 4 to FIG. 6, the roller ring 40 of the continuous variable valve duration apparatus 100 according to various embodiments of the present invention includes two guide rollers 42 slidably disposed within the camshaft slot 12 and the cam slot 24, respectively, and a plurality of contact rollers 44 contacting the roller guide portion 30.

An inner circumference of the roller guide portion 30 is cylindrical, and the plurality of contact rollers 44 may allow the roller ring 40 to be rotated smoothly within the roller guide portion 30.

The roller ring 40 includes two roller plates 46, and two guide roller axes 48 and a plurality of contact roller axes 49 which are formed between the roller plates 46, the guide rollers 42, and the contact rollers 44 are disposed thereto, respectively.

Referring to FIG. 5, a circumference C formed by the guide roller axis 48 is smaller than a circumference B formed by the contact roller axis 49. Thus, interference which may occur during rotation of each of the slots 24 and 12 and the roller ring 40 may be prevented.

Referring to FIG. 6, the roller ring 40 may include an upper roller ring 40*a* and a lower roller ring 40*b*, and is formed by connecting the upper roller ring 40*a* and the lower roller ring 40*b*. If the roller ring 40 is connected by two parts, productivity may enhanced and tolerances of the roller ring 40 and roller guide portion 30 may be simply modulated by just modulating contacting portions of the roller ring 40*a* and 40*b*.

A cam cap engage portion 26 is formed to the cam portion 20.

In the drawing, one slot drives two cams and the slot is formed to a side of the two cams as an exemplary illustrated embodiment. This scheme may be applied to an engine of which a cam cap is disposed at a center of a cylinder bore. However, the slot may be disposed between the two cams if the slot is applied to an engine of which a cam cap is disposed between bores of each cylinder.

Figure 7:
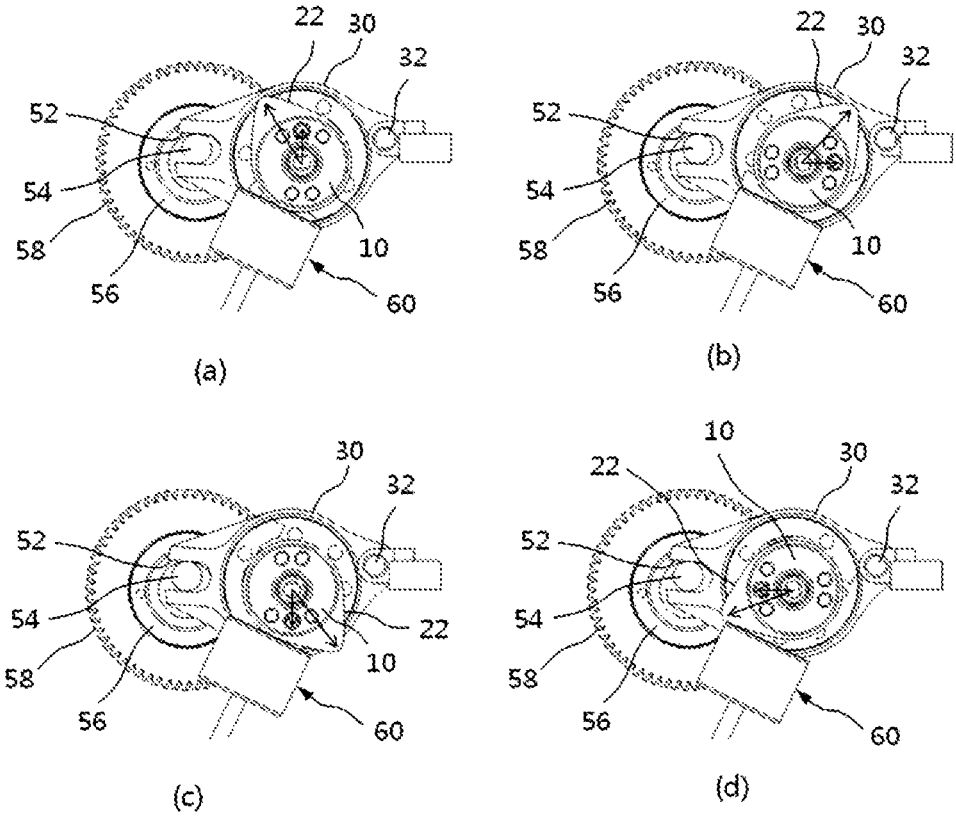
FIG. 7 to FIG. 9 are drawings showing operations of an exemplary continuous variable valve duration apparatus according to the present invention.
Figure 8:
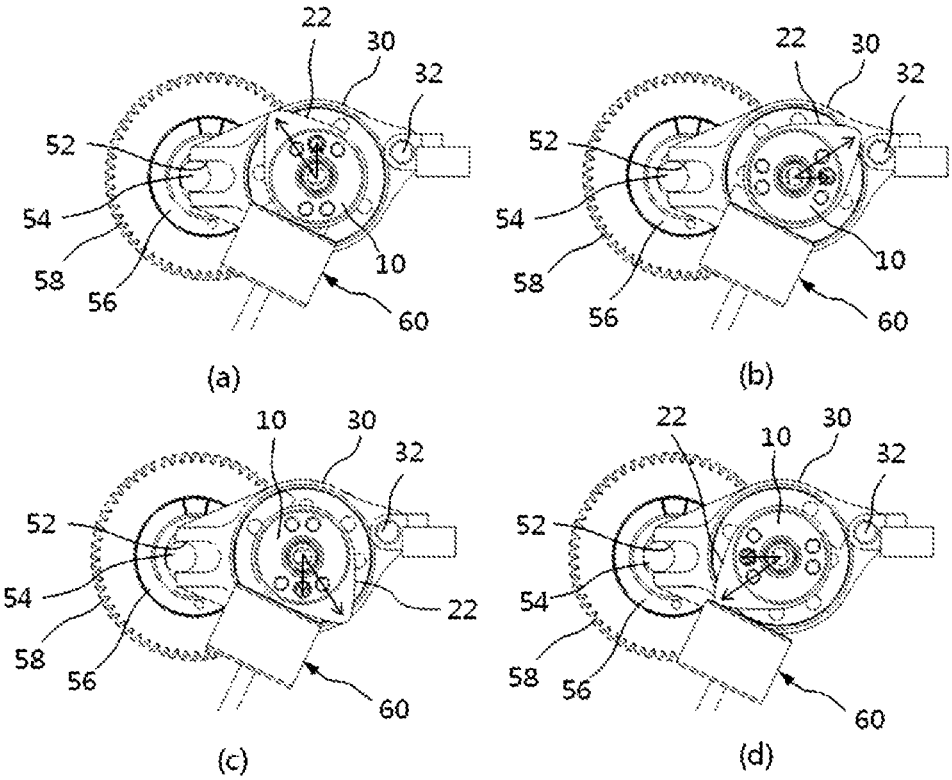
Figure 9:
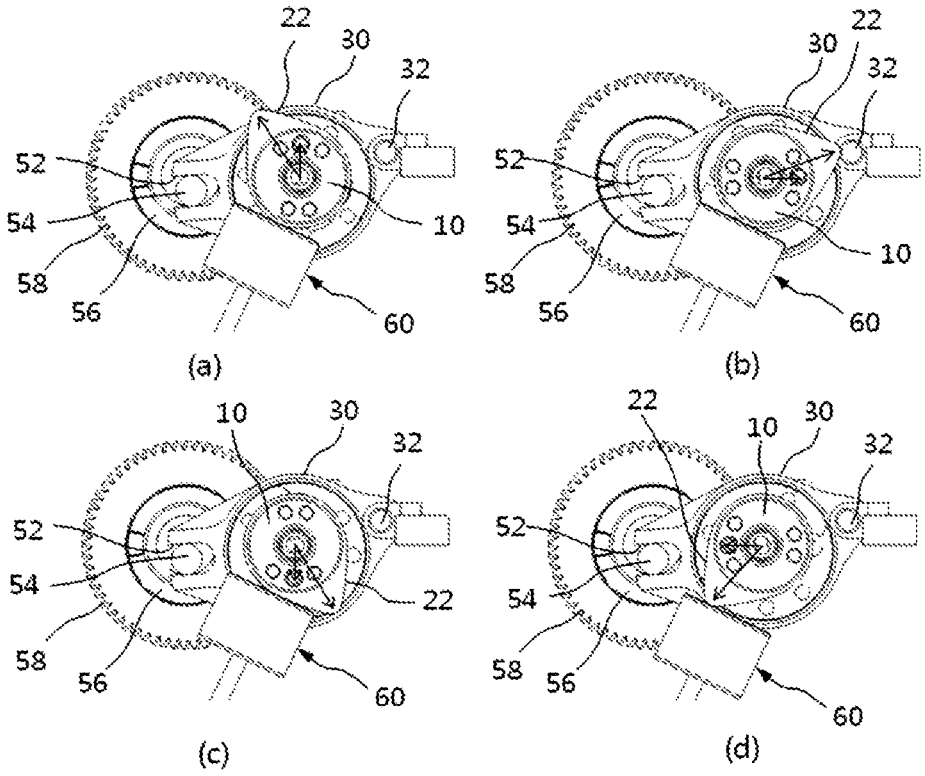

FIG. 7 to FIG. 9 are drawings showing operations of a continuous variable valve duration apparatus according to various embodiments of the present invention.

Referring to FIG. 7 to FIG. 9, operations of the continuous variable valve duration apparatus 100 according to various embodiments of the present invention will be described.

FIG. 7 is a drawing showing operation of the continuous variable valve duration apparatus 100 in a low load, FIG. 8 is a drawing showing operation of the continuous variable valve duration apparatus 100 in a middle load, and FIG. 9 is a drawing showing operation of the continuous variable valve duration apparatus 100 in a high load.

Short arrows in the drawings denote relative rotations of the camshaft 10, and long arrows denote relative rotations of the cam 22.

Reference number 58 in the drawings denotes a worm gear, a worm rotates the worm gear 58 for the control pin 54 to vary according to engine operation conditions, and positions of the roller guide portion 30 are changed according to position changes of the control pin 54 and thus the rotation center of the roller ring 40 varies.

In the FIG. 8, the rotation center of the roller ring 40 is substantially identical to the rotation center of the camshaft 10, and thus the camshaft 10, the roller ring 40, and the cam 22 are rotated at the same speed, and thus a valve 60 is constantly opened and closed.

In the FIG. 7, the relative position of the control pin 54 is higher than that of control pin 54 shown in FIG. 8, and relative rotation speed of the cam 22 to the camshaft 10 is changed. Dotted lines shown in (*b*) and (*c*) of FIG. 7 are used for comparing relative positions of the cam 22 shown in FIG. 8.

The relative rotation speed of the cam 22 to that of the camshaft 10 is retarded from (*a*) to (*b*) of FIG. 7, and the relative rotation speed of the cam 22 to that of the camshaft 10 is advanced from (*b*) to (*c*) of FIG. 7. The relative rotation speed of the cam 22 to that of the camshaft 10 is advanced from (*c*) to (*d*) of FIG. 7, and the relative rotation speed of the cam 22 to that of the camshaft 10 is retarded from (*d*) to (*a*) of FIG. 7. Therefore, the closing time of the valve 60 is relatively advanced compared to that shown in FIG. 8.

In the FIG. 9, the relative position of the control pin 54 is lower than that of the control pin 54 shown in FIG. 8, and the relative rotation speed of the cam 22 to the camshaft 10 is changed. Dotted lines shown in (*b*) and (*c*) of FIG. 9 are used for comparing relative positions of the cam 22 shown in FIG. 8.

The relative rotation speed of the cam 22 to that of the camshaft 10 is advanced from (*a*) to (*b*) of FIG. 9, and the relative rotation speed of the cam 22 to that of the camshaft 10 is retarded from (*b*) to (*c*) of FIG. 9. The relative rotation speed of the cam 22 to that of the camshaft 10 is retarded from (*c*) to (*d*) of FIG. 9, and the relative rotation speed of the cam 22 to that of the camshaft 10 is advanced from (*d*) to (*a*) of FIG. 9. Thus, the closing time of the valve 60 is relatively retarded compared to that shown in FIG. 8.

The above described local change in rotation speed may be achieved due to a difference or variation between the rotation centers of the roller ring 40 and the camshaft 10.

In (*c*) of each of FIG. 7 to FIG. 9, the valve 60 is opened. However it is not limited thereto, and on the contrary, opening times or closing times of the valve may be possible according to operation conditions of an engine.

In internal combustion engines, preferable variations of opening or closing times of valves may be realized by, for example, fixing VO (valve opening), fixing maximum opening (peak lift), fixing VC (valve closing), fixing valve duration, and so on. In various embodiments of the present invention, various strategies may be possible according to design of the hinge 32 position.

That is, effects of the CVVD may be various according to the engine operation conditions (rotation speed, operation loads) and thus, in a low speed and low load condition (including an idle condition), it is possible to minimize overlap of an intake valve and an exhaust valve (abutting intake valve opening time to top dead center, and put off intake valve closing time from bottom dead center), and thus engine pumping loss may be reduced.

In a low speed and middle load, it is possible to maximize overlap of an intake valve and an exhaust valve and put off the intake valve closing time from bottom dead center, and thus engine pumping loss may be reduced and the knocking characteristic may be improved.

In a low speed and high load, it is possible to minimize overlap of an intake valve and an exhaust valve for enhancing performance, and close the intake valve near bottom dead center for enhancing charging efficiency.

In a middle or high speed and high load, it is possible to minimize overlap of an intake valve and an exhaust for enhancing performance, and to close the intake valve according to engine speed for enhancing charging efficiency.

By applying the control strategies described above, engine fuel consumption may be improved in the low load condition and engine performance may be improved in the high load condition. The continuous variable valve duration apparatus according to various embodiments of the present invention may determine the positions of the hinge 32 and the rotation center of the roller ring 40 according to the required engine characteristic and thus various engine performances may be achieved.

For convenience in explanation and accurate definition in the appended claims, the terms upper or lower, front or rear, inside or outside, and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A continuous variable valve duration apparatus comprising:

a camshaft including a camshaft slot, the camshaft being rotationally centered about a camshaft axis;

a cam portion including a cam and a cam slot, the cam portion having a cam axis coaxial with the camshaft axis and a variable phase angle relative to the camshaft; and a duration control portion which varies the phase angle between the camshaft slot and the cam slot;

wherein the duration control portion comprises:

a roller guide portion; and a roller ring which is rotatably disposed to the roller guide portion and is connected to the camshaft slot and the cam slot;

wherein a rotational center axis of the roller guide portion is parallel to the camshaft axis, and the rotational center axis of the roller guide portion is varied; and wherein the duration control portion comprises:

a hinge connected to one side of the roller guide portion; and a roller guide portion control portion selectively rotating the roller guide portion around the hinge.

2. The continuous variable valve duration apparatus of claim 1, wherein the roller guide portion control portion comprises:

a control slot formed to the roller guide portion; and a control shaft which is parallel to the camshaft, and of which a control pin is eccentrically formed from a center of the control shaft and is inserted into the control slot.

3. The continuous variable valve duration apparatus of claim 1, wherein the camshaft slot is formed toward a radial direction thereof, and the camshaft slot direction is eccentric from the camshaft axis.

4. The continuous variable valve duration apparatus of claim 1, wherein the cam slot is formed toward a radial direction thereof, and the cam slot direction is eccentric from the camshaft axis.

5. The continuous variable valve duration apparatus of claim 1, wherein a cam cap engage portion is formed to the cam portion.

6. The continuous variable valve duration apparatus of claim 1, wherein a cam portion hole is formed to the cam portion, and the camshaft is inserted into the cam portion hole.

7. A continuous variable valve duration apparatus comprising:

a camshaft including a camshaft slot, the camshaft being rotationally centered about a camshaft axis;

a cam portion including cam and a cam slot, the cam portion having a cam axis coaxial with the camshaft axis and a variable phase angle relative to the camshaft; and a duration control portion which varies the phase angle between the camshaft slot and the cam slot;

wherein the duration control portion comprises:

a roller guide portion; and a roller ring which is rotatably disposed to the roller guide portion and is connected to the camshaft slot and the cam slot;

wherein a rotational center axis of the roller guide portion is parallel to the camshaft axis, and the rotational center axis of the roller guide portion is varied; and wherein the roller ring comprises:

two guide rollers slidably disposed within the camshaft slot and the cam slot, respectively; and a plurality of contact rollers contacting the roller guide portion.

8. The continuous variable valve duration apparatus of claim 7, wherein the roller ring comprises:

two roller plates; and two guide roller axes and a plurality of contact roller axes which are formed between the roller plates and the guide rollers and to which the contact rollers are disposed, respectively.

9. The continuous variable valve duration apparatus of claim 8, wherein a circumference formed by the guide roller axis is smaller than a circumference formed by the contact roller axis.

10. The continuous variable valve duration apparatus of claim 7, wherein the roller ring comprises an upper roller ring and a lower roller ring, and it is formed by connecting the upper roller ring and the lower roller ring.

11. A continuous variable valve duration apparatus comprising:

a camshaft including a camshaft slot, the camshaft being rotationally centered about a camshaft axis;

a cam portion to which a cam and a cam slot, the cam portion having a cam axis coaxial with the camshaft axis, and a variable phase angle relative to the camshaft;

a roller guide portion;

a roller ring which is rotatably disposed to the roller guide portion and connected to the camshaft slot and the cam slot;

a hinge connected to one side of the roller guide portion; and a roller guide portion control portion selectively rotating the roller guide portion around the hinge, wherein a relative phase angle between the camshaft slot and the cam slot is changed according to the operation of the roller guide portion control portion.

12. The continuous variable valve duration apparatus of claim 11, wherein the roller guide portion control portion comprises:

a control slot formed to the roller guide portion; and a control shaft which is parallel to the camshaft, and of which a control pin is eccentrically formed from a center of the control shaft and is inserted into the control slot.

13. The continuous variable valve duration apparatus of claim 11, wherein the roller ring comprises:

two guide rollers slidably disposed within the camshaft slot and the cam slot, respectively; and a plurality of contact rollers contacting the roller guide portion.

14. The continuous variable valve duration apparatus of claim 13, wherein the roller ring comprises:

two roller plates; and two guide roller axes and a plurality of contact roller axes which are formed between the roller plates and the guide rollers, and the contact rollers are disposed thereto, respectively.

15. The continuous variable valve duration apparatus of claim 14, wherein a circumference formed by the guide roller axis is smaller than a circumference formed by the contact roller axis.

16. The continuous variable valve duration apparatus of claim 13, wherein the roller ring comprises an upper roller ring and a lower roller ring, and it is formed by connecting the upper roller ring and the lower roller ring.

17. The continuous variable valve duration apparatus of claim 11, wherein the camshaft slot is formed toward a radial direction thereof, and the camshaft slot direction is eccentric from the camshaft axis.

18. The continuous variable valve duration apparatus of claim 11, wherein the cam slot is formed toward a radial direction thereof, and the cam slot direction is eccentric from the camshaft axis.

* * * * *